US005223804A

United States Patent [19]

Usui

[11] Patent Number: 5,223,804

[45] Date of Patent: Jun. 29, 1993

[54] FABRICATION PROCESS FOR IC CIRCUIT AND IC CIRCUITS FABRICATED THEREBY

[75] Inventor: Toshimasa Usui, Suwa, Japan

[73] Assignee: Seiko Epson Corporation, Tokyo, Japan

[21] Appl. No.: 800,225

[22] Filed: Nov. 29, 1991

[30] Foreign Application Priority Data

Nov. 28, 1990 [JP] Japan ..... 2-328058
Nov. 21, 1991 [JP] Japan ..... 3-306026

[51] Int. Cl.[5] ..... H01P 5/00; H01P 3/08

[52] U.S. Cl. ..... 333/1; 333/238

[58] Field of Search ..... 333/1, 12, 238, 125, 333/33, 24 C, 24 R, 104, 246, 127, 128

[56] References Cited

U.S. PATENT DOCUMENTS 4,383,227 5/1983 de Ronde ..... 333/238 X
4,675,620 6/1987 Fullerton ..... 333/1
4,680,557 7/1987 Compton ..... 333/1
5,027,088 6/1991 Shimizu et al. ..... 333/1

*Primary Examiner*—Robert J. Pascal
*Assistant Examiner*—Ali Neyzari
*Attorney, Agent, or Firm*—Scully, Scott, Murphy & Presser

[57] ABSTRACT

A method of minimizing line capacitance for transmission lines in integrated circuits is presented to decrease the device performance problems of time delay and noise generation caused by capacitive coupling effects. The prime objective is to decrease the high line capacitance associated with such long length lines as clock lines, buslines and analogue signal lines as well as designated lines requiring low line capacitance. A procedure for applying CAD to such a design concept is also indicated. Although the present embodiments refer to transmission lines within one layer of an IC, the basic concept outlined is applicable also to multilayer designs.

8 Claims, 4 Drawing Sheets

FABRICATION PROCESS FOR IC CIRCUIT AND IC CIRCUITS FABRICATED THEREBY

FIELD OF THE INVENTION

The present invention relates to a method for designing integrated circuits (IC) having low line capacitance, and the IC devices fabricated according to such a design.

BACKGROUND OF THE INVENTION

The conventional approach to IC circuit design and manufacturing is founded on a basic concept of maintaining a constant separation of the transmission lines.

FIG. 3 is an example of design a circuit layout based on the conventional double layer fabrication process.

In a plan view of such a design, device element regions 1, 2 are for forming such device elements as gate electrodes. In this type of IC circuitry, the transmission lines 3–8 in the first layer are connected to similar lines 9–16 in the second layer by means of the throughholes 17.

Associated with such transmission lines hereinafter referred to as the lines) 3–16, are line capacitance regions created by the influence of the neighboring lines. For example, on both sides of the line 3 on the same plane as the line 3, there exist lines 4–7 sharing the first layer in common, and thereby creating capacitance regions among the three lines concerned.

FIG. 4 is a plan view of three lines 20, 21 and 22, all of which are disposed on one plane and have the line width W1. The lines 20 and 21 are separated by a distance d1, and the lines 21 and 22 are separated by a distance d2. In the conventional designs, the spacing d1 and d2 as well as the width W1 are usually set to be about 2 μm. The line material is an aluminum film of about 0.6 to 0.8 μm thickness, and the interlayer distance of separation is set at about 0.8 μm.

If the lines are regarded as simple parallel strips, the capacitance, C, is given by an expression:

$$C=\epsilon\times\epsilon_0\times(\text{circuit area})\times(\text{spacing})$$

where $\epsilon$ is the relative interlayer dielectric constant and $\epsilon_0$ is the dielectric constant in a vacuum.

For the shape of the line shown in FIG. 5, the bottom capacitance C1 per unit length of the line 21, which has the dimensions of W1=2 μm, film thickness=0.8 μm and d1=d2=2 μm is:

$$C1=\epsilon\times\epsilon_0\times(2\div0.8)$$

and similarly the side capacitance C2 per unit length between the lines 20 and 21 is:

$$C2=\epsilon\times\epsilon_0\times(0.8\div2)$$

and similarly the side capacitance C3 per unit length between the lines 21 and 22 (not shown) is:

$$C3=\epsilon\times\epsilon_0\times(0.8\div2)$$

thereby yielding the ratio of the capacitances in the bottom region to the side region as 2.5:0.8.

On the other hand, the gate delay time in IC circuits depends on the driving power of the gate and on the gate capacitance. For the same driving power, the smaller the gate capacitance, easier it is to increase the gate speed. The circuit capacitance in IC circuits, in the meantime, is the total sum of all the gate input capacities and the line capacitance. Therefore, the lesser the line capacitance, the lesser the circuit capacity and easier it is to increase the gate speed.

However, because the conventional IC circuit designs are based on constant line spacings, the line capacitance becomes a serious source of noise generation caused by interline interferences in such long length line components as clock lines, bus lines and analogue signal lines.

The progress in fabrication technology has made it possible to decrease the line spacing as low as 1.2 μm in some trial devices.

As shown in FIG. 6, for the same line geometry but having decreased the line spacing from 2.0 to 1.2 μm, the capacitances per unit length of line 21 for the bottom and the side surfaces corresponding to FIG. 4, are:

$\epsilon\times\epsilon_0\times1.5$ for the bottom capacitance C1′ and $\epsilon\times\epsilon_0\times1.3$ for the side capacitance C2′ (also for C3′ between the lines 21 and 22).

As can be seen from the above figures, the proportion of the side capacitance in the line capacitance is fairly large. Therefore, with the progress in microcircuit fabrication technology, the effect of the side capacitance becomes even more significant and it becomes increasingly important to decrease the line capacitance.

For example, suppose an inverter is connected to the signal line 21 shown in FIG. 4, then its equivalent circuit is as illustrated in FIG. 7 (*a*). The line capacitance between the lines 20 and 21 appears as interline capacitance C1 and that between the lines 21 and 22 (not shown) as interline capacitance C2.

FIG. 7 (*b*) shows the case of the line 20 being at the supply voltage and the line 22 is grounded; if both lines are grounded, the equivalent circuit appears as shown in FIG. 7 (*c*). Comparing the circuits in FIG. 7 (*b*) and FIG. 7 (*c*), the line capacitive loads on the output terminal of the inverter are significantly different from each other. This means that the line capacitance itself can vary with the signal level in the neighboring lines. This can cause signal transmission delays within the internal IC circuitry, and in some cases, can lead to incorrect operation of the circuit itself. This will be further amplified below.

Variations in the signal level, between the line voltage and the ground in the neighboring lines 20 and 22, of the signal line 21 are the same as the voltage variations in one electrode of the capacitances C1 and C2.

Therefore, it is evident that the voltage of the load line 21 is affected by the voltage variations of the neighboring lines, the effect being larger the higher the capacitance of the neighboring lines. The effect is less if other capacitance (bottom capacitance of the lines and the gate input capacitance connected to the lines) are high.

Further, the capacitive effects are greater in noise-sensitive LSI circuits, for analogue and ECL circuits for example, than in CMOS circuits which have relatively large tolerances for noise. In these noise-sensitive devices, there are cases of erroneous actions being activated by interline capacitive coupling effects. As the technique of microcircuit fabrication develop, and interline spacing becomes small, there are more noises generated as a results of increasing capacitive coupling, leading to increased incidences of errors caused by capacitive couplings.

To summarize the problems created by the progress in microcircuit fabrication:

(1) the side surface capacitance contribution to the line capacitance becomes large, and it becomes more difficult to decrease the proportion of the side surface capacitance in the line capacitance as the interline spacing is decreased;

(2) with the increase in the side surface capacitance, there is a corresponding increase in the line capacitance in the equivalent circuit, leading to an increase in the delay time; and (3) it leads to stronger interline capacitive coupling, to higher noise levels, thus leading to faulty operation of a device.

SUMMARY OF THE INVENTION

The present invention presents a solution to the above mentioned problems associated with the conventional designs of transmission lines in IC devices, according to a method of designing transmission lines in IC microcircuits which can provide high speed and stable operation in IC devices based on such microcircuits.

In the present invention of fabricating transmission lines having regular line spacing of 1.2 μm width between the metallic lines, the spacing between certain specific lines (clock lines, buslines, analogue signal lines or those designated lines) is made wider than the regular line spacing.

According to the above invention, the capacitance between the lines is decreased by disposing those long length lines, such as clock lines, buslines, analogue signal lines or those specific lines, or the critical path lines away from the neighboring lines.

Therefore, by decreasing the interline capacitances, inconsistencies in transmission speed and noise generation are minimized, thereby leading to a device which provides high speed and stable operating characteristics.

DETAILED DESCRIPTION OF THE PREFERRED EMBODIMENTS

The preferred embodiments are explained with reference to the figures.

Figure 1:
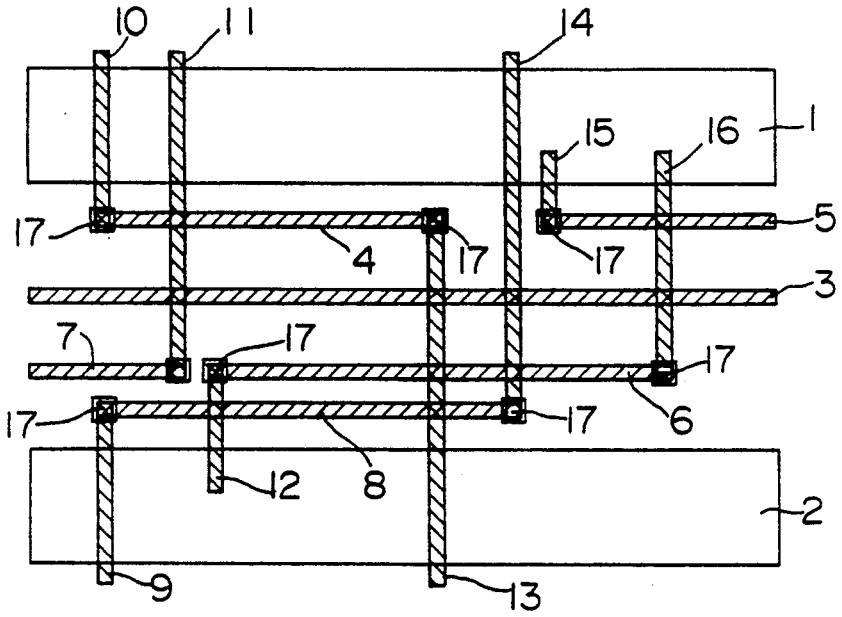
FIG. 1 is a plan view of a transmission line layout according to the present invention.
Figure 3:
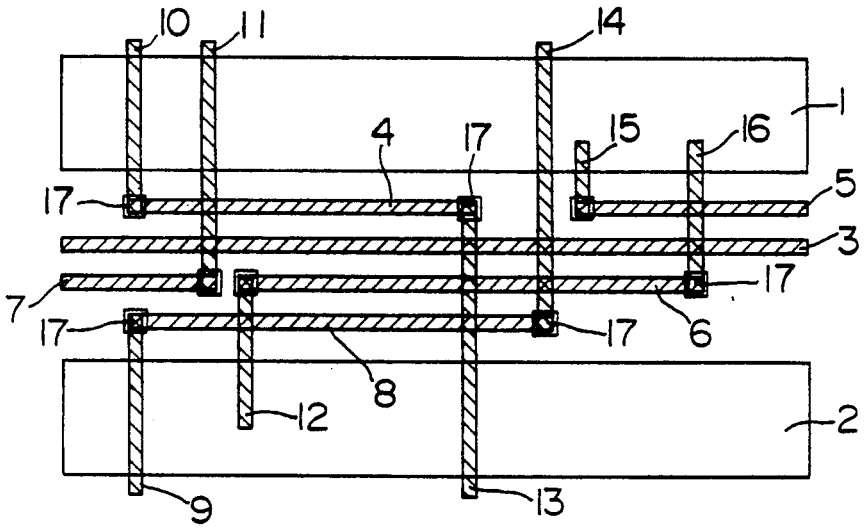
FIG.3 (PRIOR ART)
FIG. 3 is a transmission layout according to a conventional circuit design concept.
Figure 4:
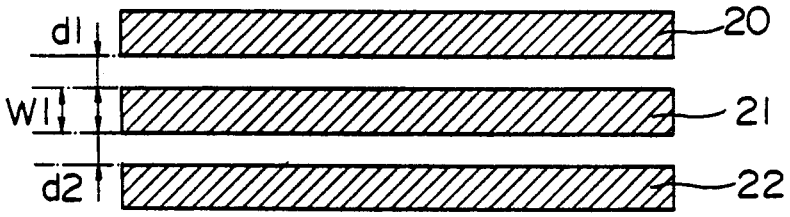
FIG.4 (PRIOR ART)
FIG. 4 is a plan view to illustrate the problems associated with the conventional transmission line design.
Figure 5:
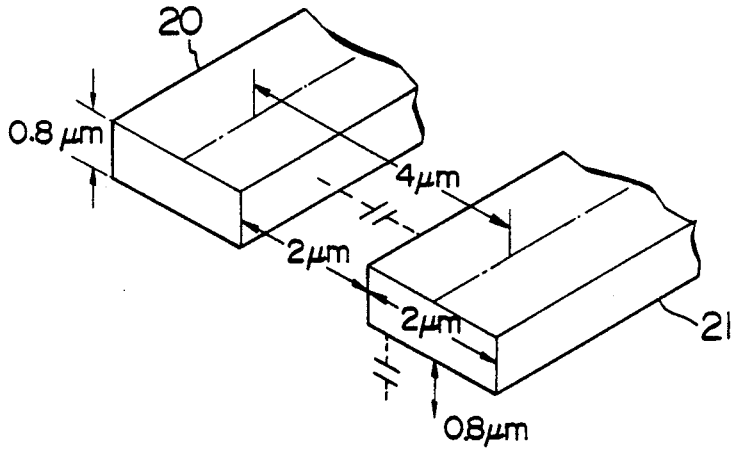
FIG.5 (PRIOR ART)
FIG. 5 is a perspective view to explain the problems associated with a similar configuration of transmission line design.
Figure 6:
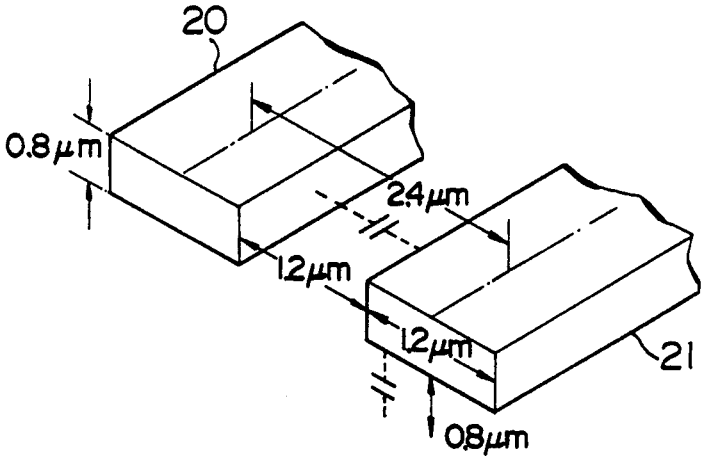
FIG.6 (PRIOR ART)
FIG. 6 is a perspective view to explain the problems associated with another similar configuration of transmission line design.
Figure 7A:
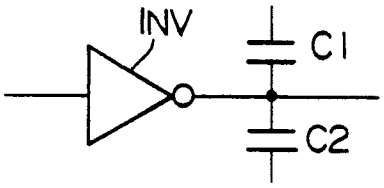
FIG. 7(a) (PRIOR ART)
FIG. 7(*a*) to FIG. 7(*c*) show equivalent circuits to explain the problems raised by the conventional designs shown in FIG. 6.
Figure 7B:
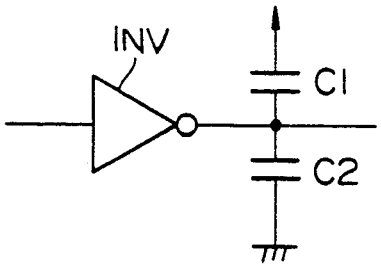
FIG. 7(b) (PRIOR ART)
Figure 7C:
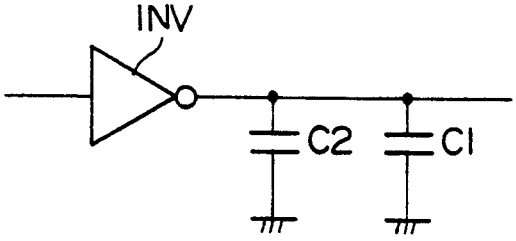
FIG. 7(c) (PRIOR ART)

FIG. 1 is a first embodiment which is similar to the conventional design shown in FIG. 3 except that the spacing between the signal transmission line 3 (referred to as the signal line) and the neighboring lines 4–7 is made larger. In the regions above and below the signal line 3, there are neighboring lines 4, 5, 6 and 7, and their interline spacing is over twice the interline spacing between the lines 6 and 8.

Those lines, like the signal line 3, which need to be separated away from their neighbors are clock lines, buslines, analogue signal lines and other such long length lines. Also included are the custom lines so designated (the so-called critical path lines) for which the spacing is set wider than for the regular lines. In gate arrays which are laid out automatically by CAD, imaginary grid lattice lines are often present, and therefore, it is best to conduct line layout in the regions away from such lattices.

FIG. 1 is an example of a layout of skipping one grid lattice separation on both sides of the signal line 3 (i.e. the adjoining grid lattices on both sides of the line 3 within the same plane). Such a design will require more chip space. However, such a procedure is not adopted for all the lines, but only for those lines for which decreased line capacitance is needed to assure functionally. Therefore, the additional chip area can be kept to a minimum. If there are sparsely disposed regions, the problem lines can be transferred to such regions, thereby minimizing the increase.

Figure 2:
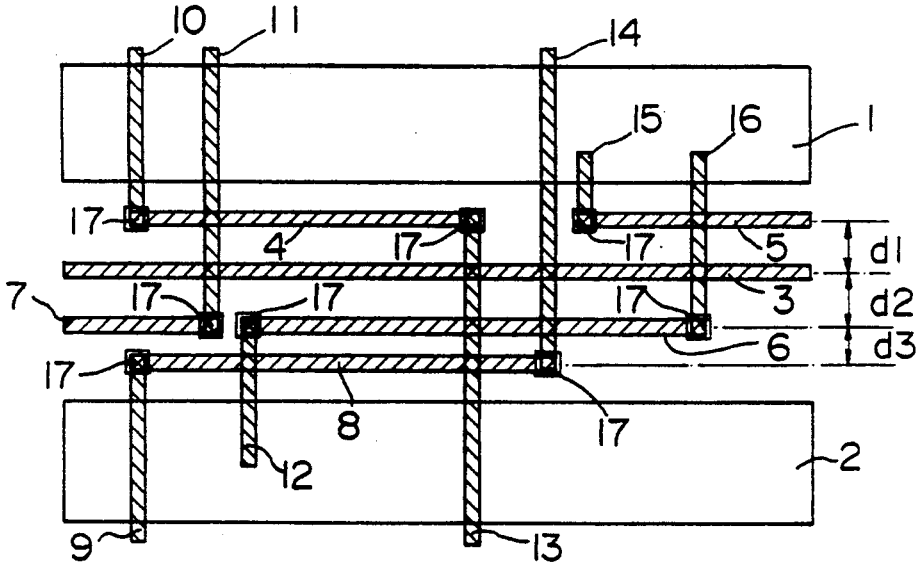
FIG. 2 is a plan view of another transmission line layout according to the present invention.

FIG. 2 illustrates a second embodiment in which the center-to-center (c/c) spacing, d1, (between the signal line 3 and the lines 4 and 5) and the c/c spacing, d2, (between the signal line 3 and the lines 6 and 7), are made to be about 1.5 times the c/c spacing, d3, (between the line 8 and the lines 6 and 7). Such a design reduces the capacitance of the signal line 3 to a minimum, and thereby leading to lowering of the overall line capacitance.

The line spacing shown in FIG. 2 is smaller than the line spacing shown in FIG. 1, therefore, the line capacitance is increased somewhat, but the chip area is kept to a minimum.

In general, for the LSI layout involving regular line spacings, such as gate arrays using CAD which provides evenly spaced lines automatically, it is more effective to skip one grid lattice line adjacent to the object line as described above. On the other hand, for manual layout or custom cells, the line spacings can be freely selected, therefore, the approach illustrated in FIG. 2 would be more applicable.

In the above embodiments, it is clearly possible to apply the concept of the present invention to select certain object lines, and perform the transferring step automatically according to some computer programs.

To illustrate the above point, the following explanation is provided for the procedure of combining the step of widening the line spacing to decrease the capacitance effect in terms of the automated CAD layout using the grid lattice lines.

For automated layout using the grid lattice lines, spaced at a given grid line pitch, it is desirable that the line spacing, the c/c distance (sum of the line width and line spacing divided by 2) be regular according to some basis, and FIG. 1 illustrated a case of widening the line spacing while maintaining the grid line pitch constant, i.e., skipped one grid lattice line. In this case, if the line width is made uniform, the line spacing is increased by the amount corresponding to one grid lattice line.

On the other hand, it is also possible to maintain the grid line pitch constant, and to widen the line spacing for the specific lines by skipping the adjacent grid lattice line spacing while simultaneously increasing the line width of the specific lines.

As described previously, the generation of noise by capacitive coupling of the neighboring lines is higher the larger the coupling capacitance, but other capacitances (such as the bottom capacitance, input gate capacitance connected to the lines) do not have a large influence. For this reason, in the case shown in FIG. 1, it is also possible not to use all of the gains (due to one grid line) made in the line spacing for the purpose of decreasing the line capacitance coupling, but to use it to increase the line width where desirable.

By adopting such measures, it is possible to decrease the capacitive coupling of neighboring lines compared with a similar layout in the conventional designs. Further, it is possible to decrease the effect of the noise generation due to capacitive coupling of neighboring lines by increasing the bottom capacitance of the line itself. In this case, the effect of noise generation due to line coupling is decreased compared with the case of not skipping a grid line, although the overall capacitance loading is not minimum for the given separation of the grid lattice lines. In this case, the circuit resistance is also decreased. As an example, for the total line length of 20 mm, the total resistance can reach up to 500 Ω for the line spacing of 1.2 μm having 30 mΩ per mm of line resistance.

For this level of resistances, because of the time constant effects by resistance and capacitive loading of the line, the delay time of a power transistor driving the signals in this circuit cannot be shortened beyond a certain limit even if the impedance of the transistor is lowered. For example, by increasing the width of the line to 2.4 μm, the line resistance can be lowered to a half of the former value, and even if the bottom capacitance is increased due to increase in the line area, because of the decrease in the impedance of the power transistor, the overall end result is a shortening of the signal delay time.

The example shown in FIG. 2 can be treated by CAD. In this case, the line spacing was 1.0 and 1.5 μm. These figures can be expressed as integers 2 and 3 μm, based on a unit of 0.5 μm base.

CAD layout can be utilized with the use of a suitable program to select certain specific lines only when the minimum reference values for specific lines can be expressed as integers. It is similarly possible to apply CAD to increasing the width of only the specific lines. It is not necessary to increase the width symmetrically with respect to the center line of the line spacing.

The layout method described in this invention is applicable to the cases having all of the following transmission line characteristics.

(1) Certain specific lines have their line spacing larger than that of the neighboring lines.

(2) The line width of the specific lines is the same as or wider than that of the neighboring lines.

(3) The grid lattice lines are disposed symmetrically adjacent to the specific line.

(4) The center-to-center spacing of the adjoining lines can be expressed in terms of integers related to the pitch of the grid lattice lines.

The above examples referred only to the case of transmission lines disposed on a common layer, but it is evident that the same concept would be applicable also to multilayer circuitry layout interconnecting over three layers, with the additional allowances for interlayer capacitance effects.

What is claimed is:

1. A method of reducing a parasitic noise generated by interline capacitance coupling in an integrated circuit containing a plurality of signal lines, said method comprising the step of widening only those line spacings between specific signal lines of long signal path length and neighboring signal lines extending parallel thereto such that said spacings are greater than a spacing between the neighboring signals lines, thereby reducing the coupling capacitance generated between a side wall of said specific signal lines and a side wall of said neighboring signal lines.

2. An integrated circuit manufactured according to the method of claim 1.

3. A method for designing signal line spacing for minimum parasitic line capacitances in an integrated circuit having grid lattice lines of a preselected separation distance, wherein first center-to-center distances between signal lines of long signal path length and neighboring signal lines extending parallel thereto are made wider than second center-to-center distances between the parallel signal lines;

a width of the signal lines of long signal path length is designed to be not less than a width of the neighboring signal lines; and the first center-to-center distances are designed to be a multiple of an integer of the grid lattice line spacing of an automated computer-aided-design layout system.

4. The method of claim 3 wherein the signal lines of long signal path length are selected from a plurality of signal lines disposed in any one layer of a multilayer integrated circuit.

5. An integrated circuit manufactured according to the method of claim 3.

6. A method for designing for minimum signal delay time of an integrated circuit having a plurality of signal lines, the method comprising the steps of:

(a) widening only those line spacings between specific signal lines having a long signal path length and neighboring signal lines which are disposed parallel to said specific signal lines such that said spacings are greater than a spacing between the neighboring signal lines to minimize parasitic side wall capacitances C generated between side walls of said specific signals lines and said neighboring signal lines; and (b) widening a line width of said specific signal lines such that said line width is greater than a line width of said neighboring signal lines to lower a resistance R of said specific signal lines, said minimum capacitance and lower resistance combining to lower a time constant RC thereby lowering the delay time of said specific signal lines.

7. An integrated circuit manufactured according to the method of claim 6.

8. The method for designing transmission lines as claimed in one of claims 1 and 6, wherein said specific transmission lines are selected from a group consisting of clock lines, buslines, analogue signal lines and preselected lines for custom purposes.

* * * * *